US007270133B2

(12) United States Patent
Wilson

(10) Patent No.: US 7,270,133 B2
(45) Date of Patent: Sep. 18, 2007

(54) SYSTEM AND METHOD FOR CLEANING ASPHALT CONTACT SURFACES

(75) Inventor: Paul A. Wilson, Cartersville, GA (US)

(73) Assignee: Victoria E. Wilson and Matthew P. Wilson Trust, Cartersville, GA (US)

( * ) Notice: Subject to any disclaimer, the term of this patent is extended or adjusted under 35 U.S.C. 154(b) by 570 days.

(21) Appl. No.: 10/793,413

(22) Filed: Mar. 4, 2004

(65) Prior Publication Data

US 2004/0173247 A1 Sep. 9, 2004

Related U.S. Application Data

(60) Provisional application No. 60/451,431, filed on Mar. 4, 2003.

(51) Int. Cl.
*B08B 3/02* (2006.01)

(52) U.S. Cl. ..... 134/56 R; 134/94.1; 134/99.2

(58) Field of Classification Search ..... 134/56 R, 134/113, 94.1, 97.1, 98.1, 99.2, 103, 100.1
See application file for complete search history.

(56) References Cited

U.S. PATENT DOCUMENTS 3,931,662 A * 1/1976 Nayfa et al. ..... 15/320
4,050,629 A * 9/1977 Query et al. ..... 239/11
5,655,713 A * 8/1997 Gibney et al. ..... 239/310
6,863,223 B2 * 3/2005 Rosa et al. ..... 239/67
2003/0080200 A1 5/2003 Rosa et al. ..... 239/67

OTHER PUBLICATIONS

Application systems. Product Data [online]. Tec-Team Industries, 2004 [retrieved on Dec. 13, 2004]. Retrieved from the Internet <URL: www.thetecteam.com/site/signin/application_systems.html>.

Tec-Shield. Product Data [online]. Tec-Team Industries, 2004 [retrieved on Dec. 13, 2004]. Retrieved from the Internet: <URL: www.thetecteam.com/site/signin/tec_shield.html>.

* cited by examiner

*Primary Examiner*—Michael Barr
*Assistant Examiner*—Saeed T. Chaudhry
(74) *Attorney, Agent, or Firm*—James W. Kayden; Thomas, Kayden, Horstemeyer & Risley, LLP

(57) ABSTRACT

Systems and methods for cleaning asphalt contact surfaces are provided. One such system includes a means for determining a dilution ratio appropriate to a particular asphalt contact surface, a nozzle proximate to the asphalt contact surface, and a pump in fluid communication with the nozzle. The pump is configured to deliver to the nozzle a mixture of water and said cleaning compound with the appropriate dilution ratio. One such method includes the steps of: pumping a cleaning mixture with a dilution ratio appropriate to a particular asphalt contact surface; supplying said pumped cleaning mixture to at least one nozzle proximate to the asphalt contact surface; and spraying the asphalt contact surface through the nozzle with the pumped mixture.

12 Claims, 5 Drawing Sheets

SYSTEM AND METHOD FOR CLEANING ASPHALT CONTACT SURFACES

CROSS-REFERENCE TO RELATED APPLICATION

This application claims priority to copending U.S. provisional application entitled, "A Method For Cleaning Various Components of Hot Mix and Cold Mix Asphalt Manufacturing Plants" having Ser. No. 60/451,431, filed Mar. 4, 2003, which is entirely incorporated herein by reference.

FIELD OF THE INVENTION

The present invention generally relates to cleaning systems and methods, and, more particularly, to systems and methods for cleaning various asphalt contact surfaces in an asphalt manufacturing plant, vehicles used to transport asphalt, and machines or tools used to apply asphalt.

BACKGROUND

Hot mix asphalt (HMA) is a material used extensively in paving roads, runways, parking areas, etc. HMA is a mixture of liquid asphalt, aggregate, and special additives. The special additives modify the final product to yield a particular set of properties suitable both to the finished material, and to handling during manufacturing, transportation, and laying of the surface. HMA is manufactured by bringing together various ingredients at an elevated temperature, mixing the ingredients, and storing the finished product before transporting to the use site.

HMA as the name implies, is hot, with typical temperatures up to and exceeding 340° F., causing problems with cleaning operations. The liquid asphalt is liquid at the elevated temperatures where it is processed into HMA, but the mixture becomes sticky and eventually solid as the temperature falls. During the manufacturing and handling processes, HMA adheres to nearly every surface it contacts. Thus, during the paving process, HMA adheres to the equipment involved in manufacturing the asphalt, in transporting the asphalt to the paving site, and in disposing the asphalt onto the particular site. The build-up of HMA on contact surfaces can result in inefficient or faulty operation of the equipment. Furthermore, at temperatures exceeding 340° F., combustible components of the HMA and liquid asphalt may catch fire, especially when built-up materials adhere to the hot mixing surfaces of the drum or pug mill.

To prevent the asphalt from sticking or adhering to the bed of the transportation vehicle, an asphalt release agent is applied to the bed prior to loading the asphalt. Various other methods are used to clean the components of the asphalt plant. Diesel fuel or similar solvents can be used to clean some components, but the risk of fire and explosions, as well as environmental concerns, render this method undesirable. Adhered asphalt can be removed using mechanical force, such as air hammers and chisels. However, this process is time consuming, ineffective, is dangerous to personnel, and can result in damage to the machinery.

Cold mix asphalt (CMA) is similar to HMA, but is mixed at a lower temperature. Also, some ingredients may be different. Despite the differences, cleaning CMA from the manufacturing plant or equipment involves many of the same problems mentioned above.

Thus, there is a need in the industry for a method of cleaning asphalt contact surfaces that overcomes at least these disadvantages.

SUMMARY

The present invention involves systems and methods for cleaning asphalt contact surfaces. In this regard, an embodiment of a system for cleaning asphalt contact surfaces in accordance with the invention includes a means for determining a dilution ratio appropriate to a particular asphalt contact surface, a nozzle proximate to the asphalt contact surface, and a pump in fluid communication with the nozzle. The pump is configured to deliver to the nozzle a mixture of water and said cleaning compound with the appropriate dilution ratio.

An embodiment of a method for cleaning asphalt contact surfaces in accordance with the invention includes the steps of: determining a dilution ratio appropriate to a particular asphalt contact surface; pumping a cleaning mixture with the dilution ratio; supplying said pumped cleaning mixture to at least one nozzle proximate to the asphalt contact surface; and spraying the asphalt contact surface through the nozzle with the pumped mixture.

Other features and/or advantages in addition to, or in lieu of, those presented above will be or may become apparent to one with skill in the art upon examination of the following drawings and detailed description. It is intended that all such additional features and/or advantages be included herein within the scope of the present invention.

DESCRIPTION OF THE DRAWINGS

The invention can be better understood with reference to the following drawings. The components of the drawings are not necessarily to scale, emphasis instead being placed upon clearly illustrating the principles of the present invention. Moreover, in the drawings, like reference numerals designate corresponding parts throughout the several views.

DETAILED DESCRIPTION

The cleaning systems and methods of the present invention, described herein, are applicable for cleaning any surface that liquid asphalt or asphalt product comes into contact with. Such a surface is referred to as an "asphalt contact surface." The systems and methods can be used to remove adhered asphalt, or as a preventative to prevent asphalt from adhering to a surface, or both. The cleaning systems and methods of the present invention thus have a variety of applications. A few example applications include cleaning: components in an asphalt manufacturing plant; vehicles used to transport the asphalt product to the use site; tools or machines used during the asphalt application process; equipment used for in-place recycling of asphalt (hot or cold); equipment used to mill or remove asphalt.

The components of an asphalt manufacturing plant may include but are not limited to: mixing drums; belts; drag slat chains and conveyors; bucket elevators and conveyors; chutes; gates; batchers; diverters; silos; pug mills; coaters; and any other asphalt contact parts, surfaces, or components. The asphalt manufacturing plant can take the form of fixed locations permanently devoted to the process, temporary setups allowing the manufacturing to take place at the use site, or even mobile units where manufacture and paving are essentially simultaneously accomplished. Equipment used to mill or remove asphalt may include milling machines and planers.

Figure 1:
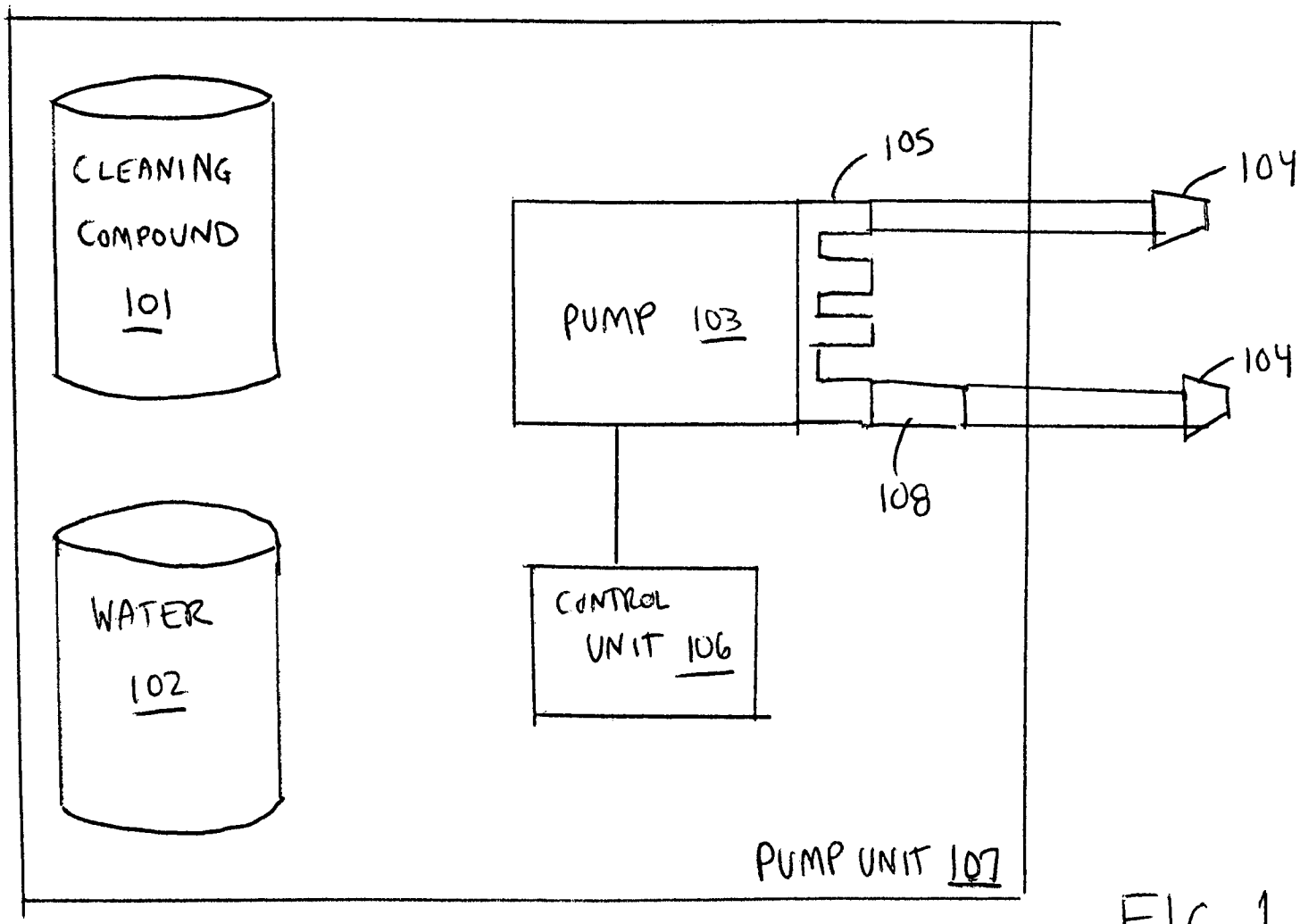
FIG. 1 is a diagram of one embodiment of the system for cleaning asphalt contact surfaces of the present invention.

FIG. 1 is a diagram of one embodiment of the system for cleaning asphalt contact surfaces of the present invention. Tank 101 stores a cleaning compound suitable for cleaning asphalt. Water supply 102 may be a tank holding water, or may be a water supply. Pump 103 draws cleaning compound from tank 101 and water from supply 102, and supplies the mixture to one or more nozzles 104. In an alternate embodiment, pump 103 may directly draw a ready-to-use (already diluted) cleaning composition.

If more than one nozzle 104 is used, then manifold 105, in fluid communication with pump 103, distributes the cleaning mixture to the plurality of nozzles 104. Various hoses and pipes known in the art may be used to communicate fluid between the fluid sources (tank 101 and supply 102), pump 103, manifold 105, and nozzles 104.

Nozzle 104 delivers the cleaning mixture in a spray pattern that is appropriate for the asphalt contact surface near the nozzle. Various nozzle designs may be used to deliver a stream, or a flat, open, or cone-shaped spray pattern. In one embodiment, nozzle 104 is fixed, and in another embodiment nozzle 104 is rotary. In one embodiment, nozzle 104 generates foam, while in another embodiment a separate foam-generating device 108 is incorporated into the cleaning system.

Pump 103 is a conventional pump, such as a centrifugal pump, a gear pump, a diaphragm pump, a plunger pump, a piston pump, or any other pump suitable for the application. In an alternate embodiment, the cleaning mixture is delivered to the asphalt contact surfaces by an air pressure system rather than pump 103. The pump 103 may be operated by any power source, such as an electric motor, an engine, air pressure, or hydraulics. Also included in pump 103 are auxiliary components such as valves, and various connection components, all known to those skilled in the art. In one embodiment, pump 103 includes a metering device which regulates the amount of cleaning compound and water drawn by the pump.

In one embodiment, pump 103 is capable of producing a pressure of between about 10 pounds per square inch and about 3000 pounds per square inch with a flow rate of between about 2 gallons per minute and about 350 gallons per minute. In another embodiment, the pump 103 is capable of producing about 5 to about 550 pounds per square inch and a flow rate of about 8 to about 88 gallons per minute.

Control unit 106 consists of various combinations of electrical and/or electromechanical components which are used to control the operation of pump 103, manifold 105, and valves (not shown). Control unit 106 includes a controller such as a microcontroller, microprocessor, programmable logic device, etc. Control unit 106 also includes adjustable timers, actuators, and sensors as necessary to control the operation of pump 103, manifold 105, and valves (not shown). Control unit 106 may also include a metering unit to control the dilution ratio of the mixture of cleaner compound and water. The appropriate dilution ratio is selected from a stored program, based on the asphalt contact surface that is being cleaned and on the cleaning formulation used.

Control unit 106 controls one or more of the following: the dilution ratio of the cleaning formulation, time and duration of application, nozzle spray pattern, foam generation, and area of application. In one embodiment, the control unit causes the pump to remain on for a period of between 5 and 390 seconds. In another embodiment, the application time is 10-90 seconds. Control unit 106 may be dedicated to any one asphalt contact surface (e.g., mixing drum or drag slat), or to multiple asphalt contact surfaces in any combination. Control unit 106 may also be incorporated into a system which applies the cleaning mixture to transportation vehicles.

Pump 103, control unit 106 and manifold 105 are shown grouped together as pump unit 107. In a preferred embodiment, these components are located in relatively close proximity to each other, while nozzles 104 are distributed throughout an asphalt manufacturing plant.

Figure 2:
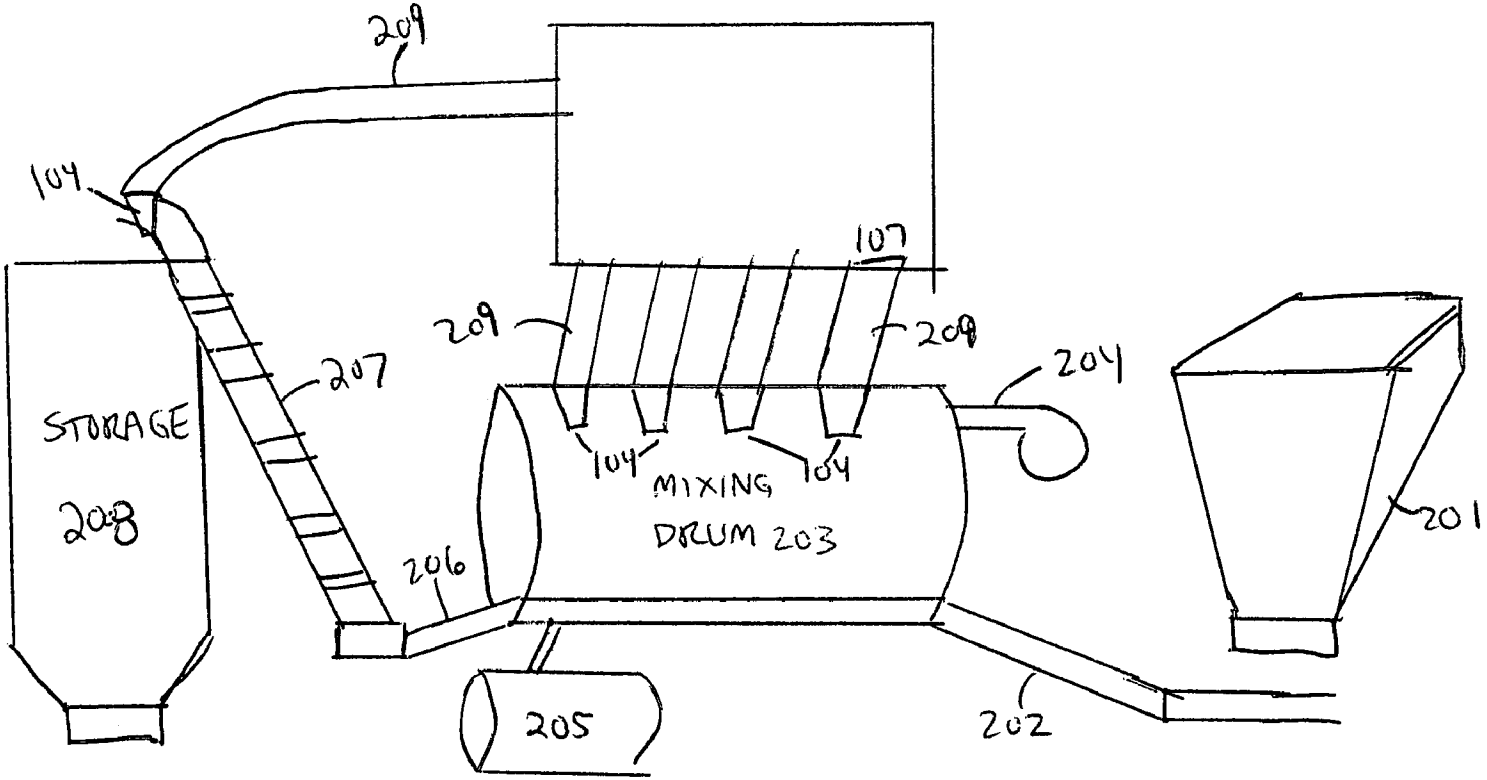
FIG. 2 is a diagram of a drum mixer-type asphalt manufacturing plant, including one embodiment of the cleaning system of the present invention.

FIG. 2 is a diagram of one embodiment of the cleaning system of the present invention diagram, shown installed in a drum mixer-type asphalt manufacturing plant. Exemplary components of a drum mixer-type plant include aggregate bin 201, conveyor 202, mixing drum 203, burner/blower 204, liquid asphalt tank 205, discharge chute 206, drag-slat conveyor 207, and storage silo 208. Aggregate such as gravel or rock is transported to mixing drum 203 by conveyor 202. Inside mixing drum 203, the aggregate is first heated and dried by burner/blower 204, and then liquid asphalt is applied and mixed with the aggregate by the rotation of the drum. The finished asphalt product exits mixing drum 203 through discharge chute 206, where it is carried by drag-slat conveyor 207 to storage silo 208. Waste products, including the cleaning compound, are transported to a waste pile (not shown) for later disposal.

In this type of plant, mixing drum 203, discharge chute 206, drag-slat conveyor 207 and storage silo 208 all come into contact with the finished asphalt and thus may need to be cleaned. Thus, in accordance with the cleaning system of the present invention, nozzles 104 may be placed in close proximity to any of these asphalt contact surfaces. Pump unit 107 then sprays a cleaning mixture of cleaning compound and water through the nozzles 104 to clean the surface.

In the example embodiment of FIG. 2, nozzles 104 are shown mounted inside mixing drum 203 and at the top and bottom of drag-slat conveyor 207. Hoses 209 connect the nozzles 104 to pump unit 107, which may be located anywhere in the plant. However, nozzles 104 can be placed near any plant component that comes into contact with the finished asphalt product. For example, additional nozzle(s) may be installed to apply the cleaning mixture to diverter(s), batcher(s), chute(s), waste gate(s), transverse conveyor(s), waste chute(s) and belt (s).

Figure 3:
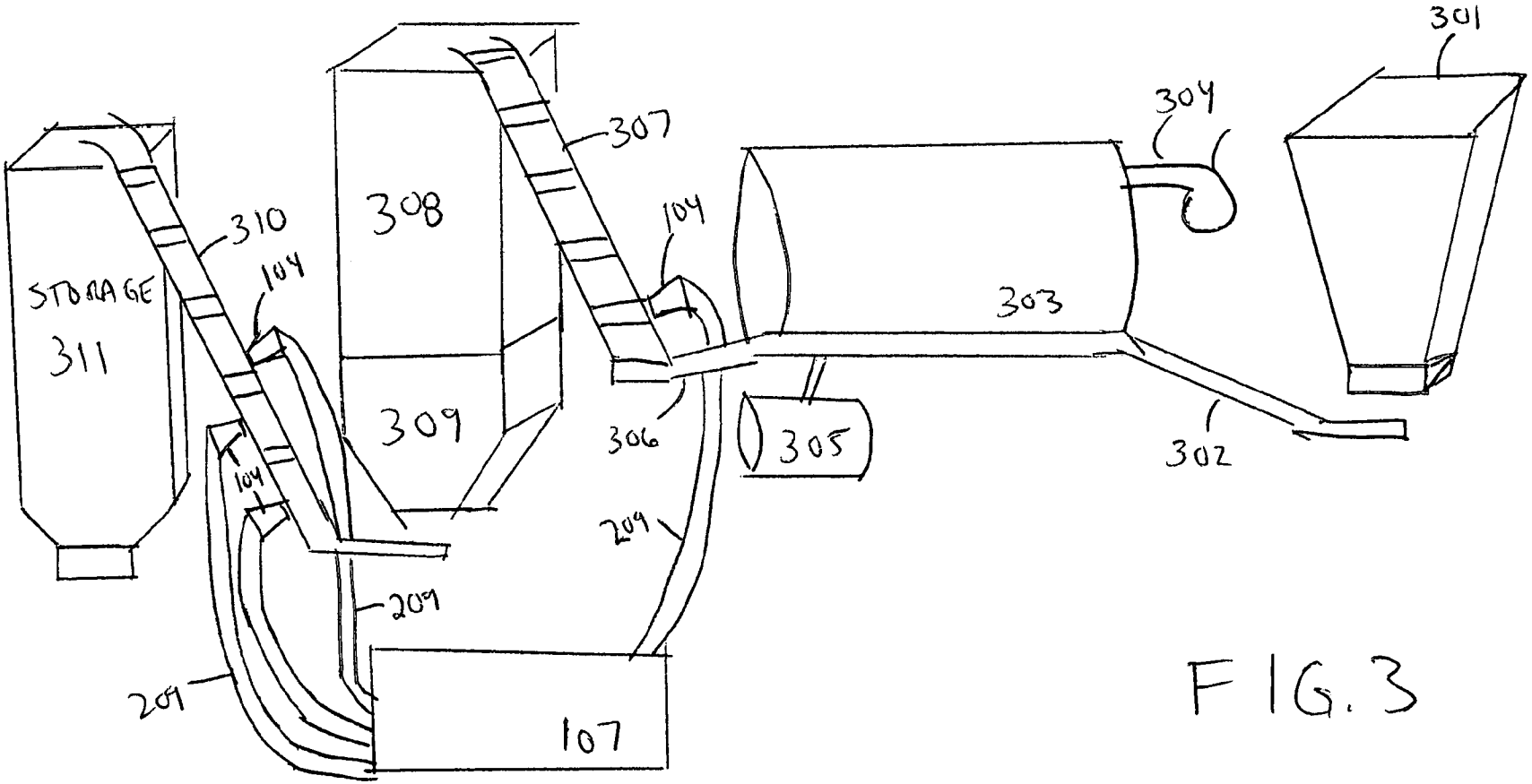
FIG. 3 is a diagram of a batch-type asphalt manufacturing plant, including one embodiment of the cleaning system of the present invention.

FIG. 3 is a diagram of one embodiment of the cleaning system of the present invention diagram, shown installed in a batch-type asphalt manufacturing plant. Exemplary components of a batch-type plant include aggregate bin 301, conveyor 302, dryer drum 303, burner/blower 304, liquid asphalt tank 305, discharge chute 306, drag-slat conveyor 307, batch tower 308, pug mill 309, drag-slat conveyor 310, and storage silo 311.

The first stage of batch processing is the same as in a drum-mixer plant, except that liquid asphalt is not applied inside dryer drum 303. The dried aggregate exits dryer drum 303 through discharge chute 306, where it is carried by drag slat conveyor 307 to batch tower 308. Liquid asphalt is applied to the aggregate inside batch tower 308, and the combination is thoroughly mixed by paddles inside pug mill 309. The finished asphalt product exits pug mill 309, and is carried by drag slat conveyor 310 to storage silo 311.

In this type of plant, batch tower 308, pug mill 309, drag-slat conveyor 310, and storage silo 311 all come into contact with the finished asphalt and thus may need to be cleaned. Thus, in accordance with the cleaning system of the present invention, nozzles 104 may be placed in close proximity to any of these asphalt contact surfaces. Pump unit 107 then sprays a cleaning mixture of cleaning compound and water through the nozzles 104 to clean the surface.

In the example embodiment of FIG. 3, nozzles 104 are shown mounted along drag slat conveyor 307. Hoses 210 connect the nozzles 104 to pump unit 107, which may be located anywhere in the plant. However, nozzles 104 can be placed near any plant component that comes into contact with the finished asphalt product.

Figure 4:
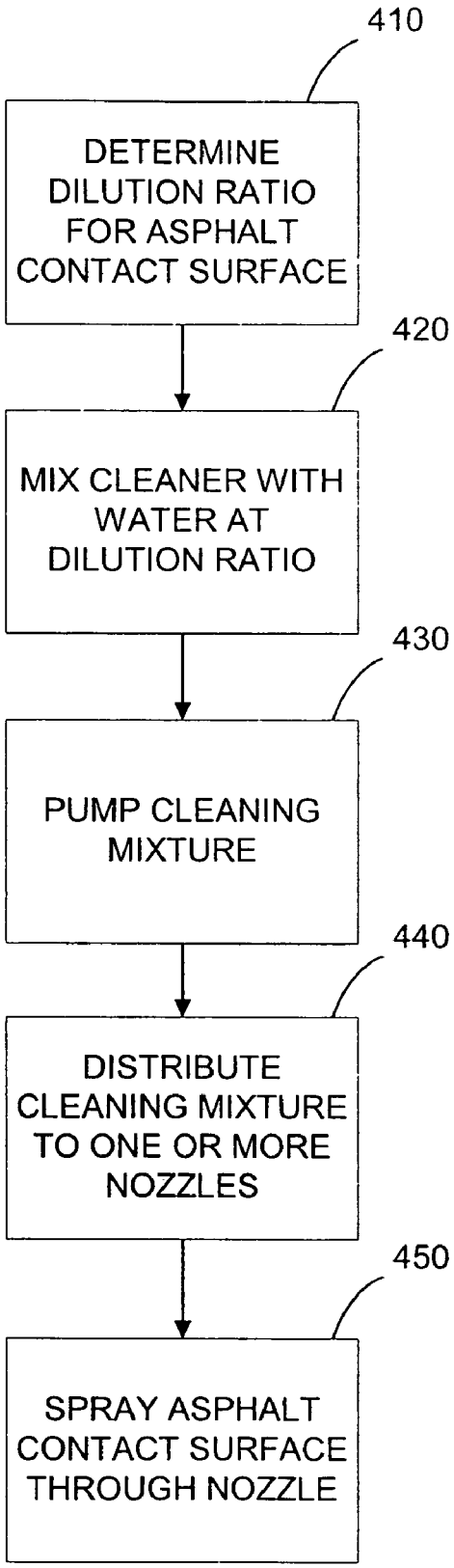
FIG. 4 is a flow chart of one embodiment of the method for cleaning asphalt contact surfaces of the present invention.

FIG. 4 is a flow chart of one embodiment of the method for cleaning asphalt contact surfaces of the present invention. In step 410, the dilution ratio of cleaning compound to water is determined for a particular asphalt contact surface to be cleaned, such as the mixer drum, or the drag-slat conveyor. In step 420, the cleaning compound is mixed with water in the determined dilution ratio. In step 430, the cleaning mixture is pumped, and in step 440, the cleaning mixture is distributed to one or more spray nozzles located near the asphalt contact surface to be cleaned. In step 450, the cleaning mixture is sprayed through the nozzle onto the asphalt contact surface.

Figure 5:
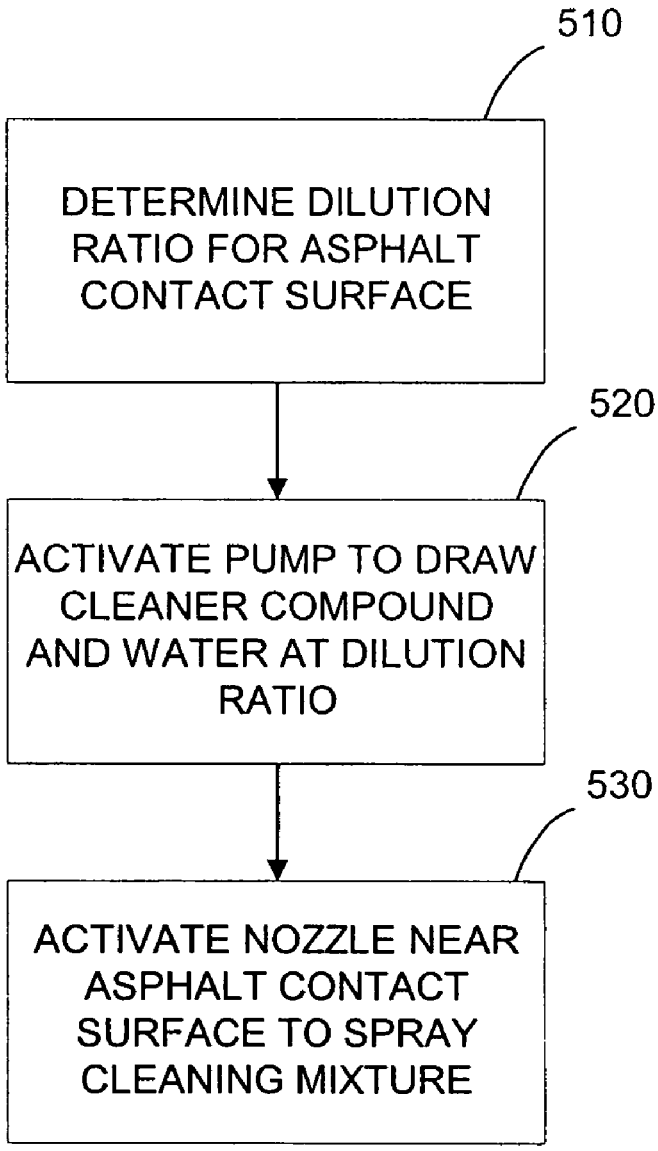
FIG. 5 is a flow chart of another embodiment of the method for cleaning asphalt contact surfaces of the present invention.

FIG. 5 is a flow chart of another embodiment of the method for cleaning asphalt contact surfaces of the present invention. In step 510, the dilution ratio of cleaning compound to water is determined for a particular asphalt contact surface to be cleaned, such as the mixer drum, or the drag-slat conveyor. In step 520, the pump is activated to draw cleaning compound and water in the determined dilution ratio. In step 530, one or more spray nozzles, in fluid communication with the pump, are activated to spray the asphalt contact surface located nearby.

It should be emphasized that the above-described embodiments of the present invention, particularly, any "preferred" embodiments, are merely possible examples of implementations set forth for a clear understanding of the principles of the invention. Many variations and modifications may be made to the above-described embodiments of the invention without departing substantially from the spirit and principles of the invention. All such modifications and variations are intended to be included herein within the scope of the present invention and protected by the following claims.

The invention claimed is:

1. A system for cleaning asphalt contact surfaces, comprising:

means for determining a dilution ratio appropriate to a particular asphalt contact surface, said dilution ratio comprising a ratio between water and a cleaner compound;

a nozzle proximate to said asphalt contact surface;

a pump in fluid communication with said nozzle configured to deliver to said nozzle a mixture of water and said cleaning compound with said dilution ratio.

2. The system of claim 1 wherein said pump is capable of producing pressure in the range of 5-5000 lbs/in$^2$.

3. The system of claim 1 wherein said pump is capable of generating flow at a rate in the range of 2-350 gals/min.

4. A system for cleaning asphalt contact surfaces, comprising:

means for determining a dilution ratio appropriate to a particular asphalt contact surface, said dilution ratio comprising a ratio between water and a cleaner compound;

a nozzle proximate to said asphalt contact surface;

a pump in fluid communication with said nozzle; and a first control unit operating said pump such that said pump delivers to said nozzle a mixture of water and said cleaning compound with said dilution ratio.

5. The system of claim 4 wherein said first control unit is configured to activate said pump for a period of between 15 and 390 seconds.

6. The system of claim 4 wherein said first control unit is configured to activate said pump at specific times.

7. The system of claim 4 wherein said pump is capable of producing pressure in the range of 5-5000 lbs/in$^2$.

8. The system of claim 4 wherein said pump is capable of generating flow at a rate in the range of 2-350 gals/min.

9. The system of claim 4 further comprising:

a means for generating foam.

10. The system of claim 4 further comprising:

a plurality of nozzles, each nozzle proximate to said asphalt contact surface; and a manifold configured to distribute said cleaning mixture to said plurality of nozzles.

11. The system of claim 10 further comprising:

a second control unit configured to activate a selected one of said plurality of nozzles.

12. The system of claim 10 further comprising:

a means for generating foam attached to said manifold.

* * * * *